US007429819B2

(12) United States Patent
Kijima et al.

(10) Patent No.: US 7,429,819 B2
(45) Date of Patent: Sep. 30, 2008

(54) DISPLAY DEVICE

(75) Inventors: Yuuichi Kijima, Chosei (JP); Shigemi Hirasawa, Chiba (JP); Hiroshi Kawasaki, Ooamishirasato (JP)

(73) Assignee: Hitachi Displays Ltd., Mobara-Shi (JP)

( * ) Notice: Subject to any disclaimer, the term of this patent is extended or adjusted under 35 U.S.C. 154(b) by 19 days.

(21) Appl. No.: 11/074,712

(22) Filed: Mar. 9, 2005

(65) Prior Publication Data

US 2005/0218784 A1 Oct. 6, 2005

(30) Foreign Application Priority Data

Mar. 10, 2004 (JP) ..... 2004-067375

(51) Int. Cl.
*H01J 9/26* (2006.01)
*H01J 1/88* (2006.01)

(52) U.S. Cl. ..... 313/292; 313/512; 445/25

(58) Field of Classification Search ..... 29/740; 294/64.1; 313/292, 512; 501/15; 445/25, 445/57

See application file for complete search history.

(56) References Cited

U.S. PATENT DOCUMENTS 4,325,489 A * 4/1982 Russell et al. ..... 220/2.2
5,731,660 A * 3/1998 Jaskie et al. ..... 313/495
6,605,893 B2 8/2003 Ando
6,611,312 B2 8/2003 Kijima et al.
6,821,179 B2 * 11/2004 Ando ..... 445/25
2004/0080261 A1 4/2004 Yokota et al.

FOREIGN PATENT DOCUMENTS

JP 2003-123673 4/2003

* cited by examiner

*Primary Examiner*—Mark Hellner
(74) *Attorney, Agent, or Firm*—Antonelli, Terry, Stout & Kraus, LLP.

(57) ABSTRACT

An image display device is constructed to prevent warping of a face substrate and a back substrate, can ensure the hermetic bonding of a support body, which is interposed between both substrates and is constituted of a combined body formed of a plurality of members, can easily from a large screen of the display device, and can enhance a hermetic property maintaining function. For this purpose, the support body, which is interposed between the face substrate and the back substrate and surrounds a display region, is formed of a projected parallel assembled body formed by combining a plurality of rod-like members having joining portions that cross each other at an approximately right angle. Projecting portions, which are constituted of distal end portions of the rod-like members, extend outwardly and are provided on a side of the support body outside of the display region.

8 Claims, 8 Drawing Sheets

PRIOR ART
FIG. 19
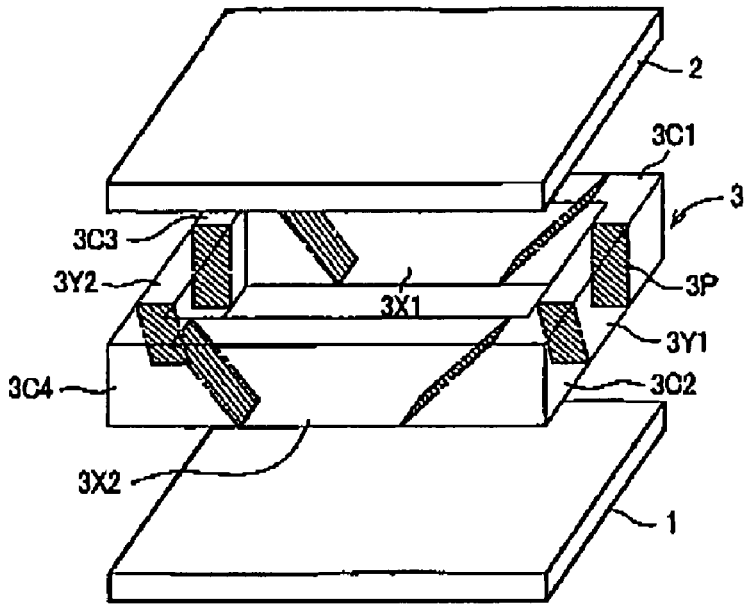
FIG. 20 (a) FIG. 20 (b)
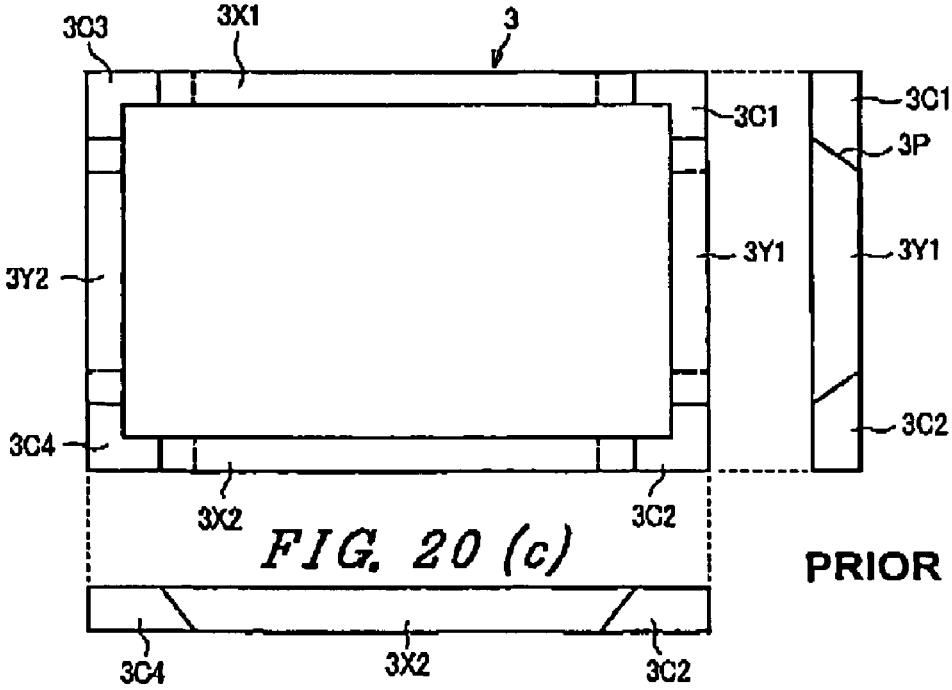
FIG. 20 (c)
PRIOR ART

DISPLAY DEVICE

BACKGROUND OF THE INVENTION

The present invention relates in general to an image display device, and, more particularly, the present invention relates to an image display device provided with a support body which is inserted between substrates and surrounds a sealed space forming a display region.

As an image display device which exhibits high brightness and high definition, a color cathode ray tube has been popularly used conventionally for many years.

However, along with recent improvements in the high quality of information processing equipment and television broadcasting, there has been a demand for a flat-panel-like display device (panel display) which possesses excellent properties, such as high brightness and high definition, and which is light-weight and requires a small space for installation.

As a typical example of such a flat-panel-like display device, a panel display device such as a liquid crystal display device, a plasma display device or the like, has been put into practical use.

Among these types of panel display devices, various types of devices have been proposed, including a field (electron) emission type display device, which is particularly capable of exhibiting high brightness, an organic EL display device, which is characterized by low power consumption, and the like.

Among such panel-type display devices, in display device in which a sealed space is defined between two substrates consisting of a face substrate and a back substrate, and in which an inner pressure of the sealed space is set to be lower than the ambient atmospheric pressure or in which a vacuum is created in the sealed space, there is provided a support body which maintains a gap between the two substrates at a given value and, at the same time, maintains the hermetic property by surrounding the sealed space.

FIG. 18 is a cross-sectional view showing one example of a known field-emission-type image display device. In FIG. 18, the field-emission-type image display device is configured such that a frame-like support body 3, which is formed as an integral body, is inserted between inner peripheral portions of a back substrate 1 and a face substrate 2, which faces the back substrate 1 in an opposed manner; the support body 3 is sealed to the back substrate 1 and the face substrate 2 using a sealing material 4; and the inner space, which is surrounded by the support body 3 and defines a display region, is held at a pressure lower than the ambient atmospheric pressure or in a vacuum state.

The image display device includes field-emission-type electron sources 5, control electrodes and the like formed on an inner surface of the back substrate 1, and, at the same time, anodes and phosphor layers 6 are formed on an inner surface of the face substrate 2. Further, numeral 7 indicates spacers which serve to maintain a predetermined distance between both substrates within the display region.

The back substrate 1 is preferably made of a material such as glass, ceramics or the like, while the face substrate 2 is preferably made of a material having optical transmissivity, such as glass or the like. Further, the support body 3 is preferably made of a material such as glass, ceramics or the like and is fixed to the inner peripheries of the back substrate 1 and the face substrate 2 using a sealing material 4 made of frit glass or the like. The inner space defined by the back substrate 1, the face substrate 2 and the support body 3 is evacuated to a degree of vacuum of, for example, $10^{-5}$ to $10^{-7}$ Torr. Further, the above-mentioned electron sources 5 are formed of, for example, carbon nanotubes (CNT), diamond-like carbons (DLC) or other field-emission-type cathode materials.

In such a panel display device, with respect to the support body which surrounds the display region and which reserves to maintain a predetermined distance between both substrates, the above-mentioned integral-body-type support body and a support body which is constituted by joining a plurality of wall members, as shown, for example, in FIG. 19, have been employed.

FIG. 19 is a diagram showing a display device which is disclosed in Japanese Patent Laid-open 2002-298761 (patent literature 1) and is a developed perspective view showing an example of the back substrate 1, the face substrate 2 and the support body 3.

In the display device shown in FIG. 19, the back substrate 1 and the face substrate 2 are each formed of a glass plate, while the support body 3 is formed of a glass material. Here, various structural elements which are formed on the respective inner surfaces of the back substrate 1 and the face substrate 2 are omitted from the drawing.

In FIG. 19, the support body 3, having a given thickness, is inserted between the peripheries of the back substrate 1 and the face substrate 2, and the support body 3 is sealed to the back substrate 1 and the face substrate 2 using a sealing material so that a fixed gap is provided between the back substrate 1 and the face substrate 2, thus forming a sealed space in the inside thereof. The support body 3 is divided into a plurality of wall members 3X1, 3X2, 3Y1, 3Y2, 3C1 to 3C4.

On portions where the respective wall members 3X1, 3X2, 3Y1, 3Y2, 3C1 to 3C4 are arranged close to each other and are engaged with each other, inclined surfaces 3P are formed. Further, an intersecting angle, which is established between a normal line which is erected from the inclined surface 3P and a normal line which is erected from the back substrate 1 or the face substrate 2, is set to an acute angle.

FIG. 20A, FIG. 20B and FIG. 20C are three views showing the support body shown in FIG. 19, wherein FIG. 20A is a plan view, FIG. 20B is a short-side side view and FIG. 20C is a long-side side view. Symbols used in these drawings correspond to the symbols used in FIG. 19.

As shown in FIG. 20A, FIG. 20B and FIG. 20C, the support body 3 of this example is divided into two long-side wall members 3X1, 3X2, two short-side wall members 3Y1, 3Y2, and four corner wall members 3C1, 3C2, 3C3, 3C4. The support body 3 is constituted by securing these members to each other at the respective inclined surfaces 3P using an adhesive, for example.

Further, Japanese Patent Laid-open 2000-311630 (patent literature 2) discloses a technique in which a display device includes a first frame member which embraces electron emission elements and a second frame member which embraces the first frame member. These first and second frame members are positioned and fixed by arranging a plurality of plate-like members in a rectangular shape, and respective contact portions are melted using a burner, thus forming a support body by welding.

Further, Japanese Patent Laid-open 2000-184329 (patent literature 3) discloses a technique in which a side wall is provided between a face substrate and a back substrate; a background layer and an indium layer made of a metal sealing material are stacked and arranged on a sealing surface between the side wall and the face substrate; and at least one of the background layer and the indium layer includes a projecting portion which projects from the sealing surface. When an extra metal sealing material is generated at the time of sealing both substrates by heating and melting indium in a vacuum atmosphere, the extra metal sealing material is extended to the projecting portion, thus preventing the extra metal sealing material from flowing out to the electron sources and lines.

SUMMARY OF THE INVENTION

In the above-mentioned technology, with regard to the technique in which two glass plates are adhered and fixed by way of a support body having an integral frame structure, when the display device becomes large-sized (in response to a demand for a large screen), the support body is liable to be easily broken during the handing thereof, and waste materials, are produced during the selection of materials thus eventually pushing up the cost of the display device.

To obviate such a drawback, it has been proposed to employ the technique shown in FIG. 19 or the like, in which the support body is divided into a plurality of members, and these members are assembled and adhered to each other.

This assembled and adhered support body has several characteristics, one of which is that the assembled and adhered support body can more easily overcome the rupture problem compared to the above-mentioned support body having an integral frame structure. Also, the display device can be manufactured at a low cost by obviating the generation of waste materials with respect to the selection of materials.

However, in sealing both substrates and the support body by way of the sealing material, a load is applied to both substrates in an orthogonal direction (Z direction) with respect to the respective plate surfaces. Accordingly, to prevent the bonding portions of the respective divided members of the support body from being displaced in the X, Y directions in which the bonding portions are separated from each other, the use of jigs becomes necessary.

Further, there also arises a drawback in that, even in an evacuation step which follows the sealing operation, it is necessary to use the jigs again to restrict the displacement of the respective divided members of the support body, and it has been one of the objectives in this technical field to overcome this drawback.

Further, with respect to the technology in which a plurality of plate-like members are positioned and fixed in a rectangular shape and the respective contact portions are melted using a burner, thus forming the support body by melting, the technique has drawbacks, such as the occurrence of a deformation attributed to the welding, the indispensable need for a shaping step for rectifying the deformation, the pressure of an adverse working environment due to heating using a burner, and an inefficient operability. Accordingly, the adoption of this technique has been avoided, and a technique which fixes divided members using, an adhesive material has been recommended.

Further, in a region from an outside end of the support body to an outside end of the substrate, although a gap which is approximately equal to the thickness of the support body exists, the gap in this region becomes a factor which is liable to promote a warping of the substrate, and a solution of such a drawback has been another one of the problems to be solved in this technical field.

Accordingly, the present invention has been made to overcome the above-mentioned drawbacks, and, for this purpose, it is an object of the present invention to provide a display device which includes a support body having projecting portions which project in a direction toward an extend into an area outside the display region.

Due to such a constitution, it is possible to provide an image display device which can suppress the occurrence of leaking, which exhibits the desired high-quality display and which can easily realize a large-sizing of an image display screen.

According to the present invention, it is possible to obtain a large-sized (large-screen) display device having a high definition in which warping of a substrate can be prevented by interposing a support body having projecting portions which project in a region outside of the display region toward the outside edge of the substrates.

According to the present invention, by combining and bonding a plurality of rod-like members to have a projected parallel shape to form the support body, distal end portions of the rod-like members constitute projecting portions, wherein these projecting portions are interposed between the substrates in the region outside of the display region toward the outside edge of the substrates, thus preventing a warping of the substrates, whereby a large-sized (large-screen) display device having the high definition can be obtained.

Further, by adopting members disposed in a projected parallel shape in forming the support body using the rod-like members, it is possible to suppress displacement of the mutual combined rod-like members in the X, Y directions, and, hence, maintenance of the hermetic property becomes more is reliable.

Further, by adopting the members disposed in a projected parallel shape in forming the support body using rod-like members, it is possible to suppress displacement of the combined rod-like members in the X, Y directions, and, hence, it is possible to restrict such displacement without using jigs.

According to the present invention, by providing joining portions at positions closer to the center from the longitudinal end portions of the rod-like members which constitute the support body, it is possible to interpose portions which are disposed more toward the longitudinal end portions than the joining portions in the region from the outside edge of the support body to the outside edge of the substrate, and, hence, warping of the substrate can be prevented, and, at the same time, it is possible to obtain a large-sized (large-screen) display device having a high definition.

Further, it is possible to suppress deformations of the combined rod-like members in the X, Y directions.

According to the present invention, it is possible to easily form the joining portions.

Further, according to the present invention, it is possible to realize a reliable maintenance of the hermetic property and a suppression of displacements.

According to the present invention, by providing recessed portions and inclined surfaces which restrict any displacement in both of the X, Y directions, it is possible to obtain a more reliable maintenance of the hermetic property.

Further, the displacements can be restricted without using jigs.

According to the present invention, the joining portions can be formed easily and at a low cost, and, further, the maintenance of the hermetic property becomes more reliable.

Further, the displacements can be regulated without using jigs.

According to the present invention, since the sealing portion exists in a region from the outside edge of the support body to the outside edge of the substrates, it is possible to obtain a large-sized (large-screen) display device which can prevent a warping of the substrate and, at the same time, which exhibits a high definition.

BRIEF DESCRIPTION OF THE DRAWINGS

FIG. 19 is a developed perspective view showing an example of a conventional image display device; and FIG. 20A is a plan view and FIG. 20B and FIG. 20C are side views showing the conventional support body shown in FIG. 19.

DESCRIPTION OF THE PREFERRED EMBODIMENTS

Figure 1:
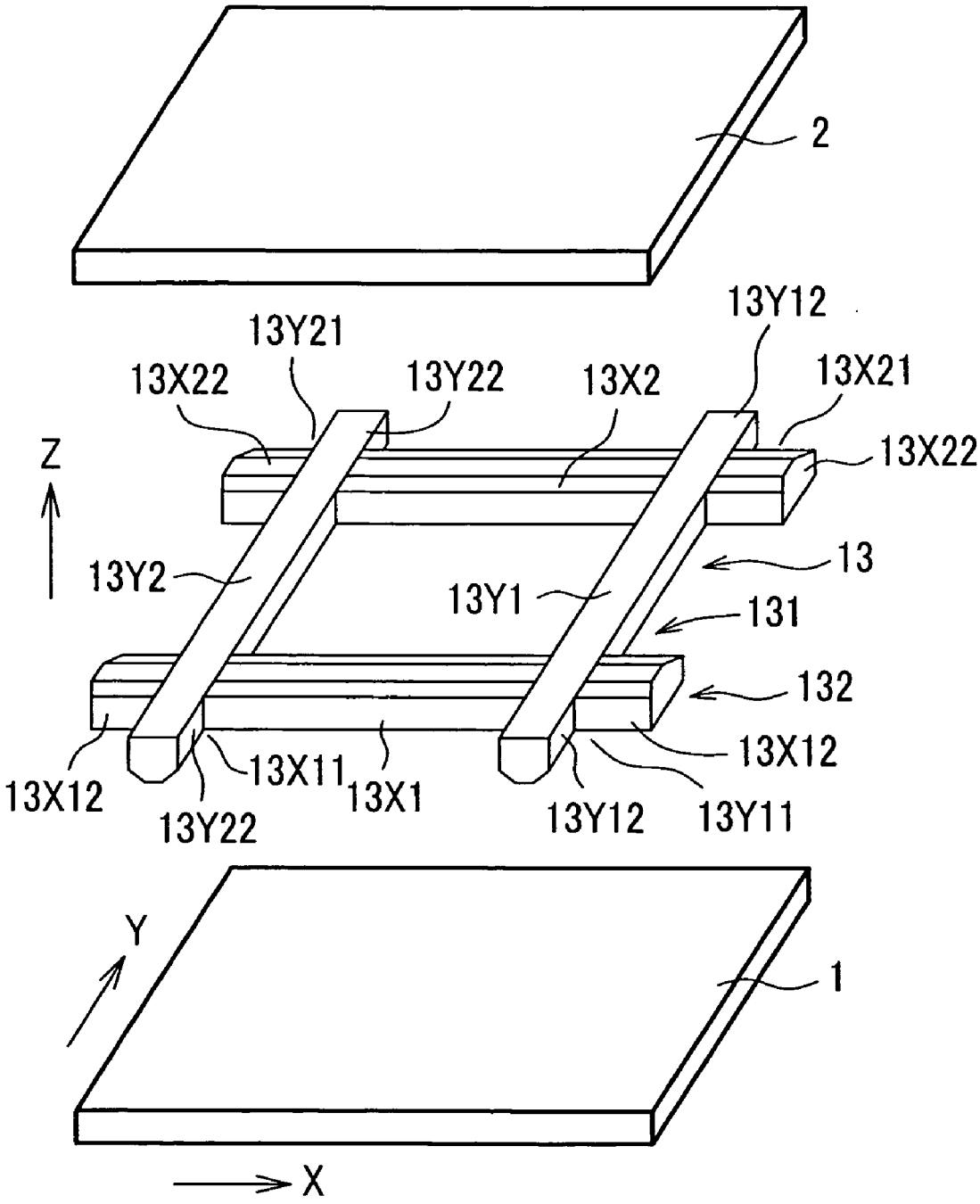
FIG. 1 is a developed perspective view showing one embodiment of an image display device according to the present invention.

An image display device according to the present invention is characterized in that a support body, which is interposed between both substrates and surrounds a display region, includes projecting portions which project in a direction away from the display region.

Hereinafter, representative constitutions of the image display device of the present invention will be described.

In an image display device which includes a face substrate having anodes and phosphors formed on an inner surface thereof, a back substrate having a plurality of electron sources formed on an inner surface thereof and which faces the face substrate in an opposed manner with a given distance therebetween, a support body which is interposed between the face substrate and the back substrate, surrounds a display region and maintains the given distance between the substrates, and a sealing material which hermetically seals end surfaces of the support body and the face substrate and the back substrate, the support body includes projecting portions which project in a direction away from the display region.

Further, the image display device according to the present invention is configured such that the projecting portions are provided to corner portions of the support body. Alternatively, the projecting portions may be provided to the respective corner portions. Further, the support body may be constituted of a plurality of rod-like members which are combined and bonded as projected parallel members, and the projecting portions are provided outside the bonding portions.

Further, the rod-like members may be provided with joining portions such that the bonding portions are formed at positions spaced in the center direction from longitudinal end portions thereof. Still further, the rod-like members may be provided with joining portions on the longitudinal end portions.

Further, the joining portion includes recessed portions and inclined surfaces which restrict displacement of the members in both X and Y directions and the joining portion may be formed into an approximately polygonal or square hole.

Further, the projecting portions may include a sealing material.

Due to the above-mentioned constitutions, it is possible to provide an image display device which can exhibit an excellent hermetic property maintenance function, can produce high-quality display, and realize a large-sizing of a screen.

Here, it is needless to say that the present invention is not limited to the above-mentioned constitution and the constitutions of embodiments to be described later and that various modifications can be made without departing from the technical concept of the present invention.

Embodiment 1

Embodiments of the present invention will be explained in detail in conjunction with the accompanying drawings.

Here, although an explanation will be given with respect to a case in which the present invention is applied to a field emission type display device (FED), the present invention is applicable to other types of display device or similar equipment in the same manner.

FIG. 1 is a developed perspective view of the first embodiment of an image display device according to the present invention, showing an example of a back substrate, a face substrate and a support body.

In this image display device, the back substrate 1 and the face substrate 2 are each formed of a glass plate, and the support body 13 is formed of a glass material. Here, various elements, such as electron sources, phosphor layers and the like, which are formed on respective inner surfaces of the back substrate 1 and the face substrate 2 are omitted from the drawing.

In FIG. 1, the support body 13, having a given thickness, is interposed between the back substrate 1 and the face substrate 2, and these members are fixed to each other with a given gap between the back substrate 1 and the face substrate 2, thus defining a sealed space in which a display region is formed.

The support body 13 is configured such that a plurality of rod-like members 13X1, 13X2, 13Y1, 13Y2 are combined in a projected-parallel shape to form an approximately rectangular frame body 131 having a size sufficient to surround the display region, and projecting portions 132 which are arranged outside the frame body 131. A height of the support body 13 is set so as to be uniform over the whole surface.

The respective rod-like members 13X1 to 13Y2 include joining portions 13X11, 13X21, 13Y11 and 13Y21 having constitution to be described later at the respective engaging portions thereof with the rod-like members to be combined, wherein the respective rod-like members 13X1 to 13Y2 are adhered and fixed to each other at these joining portions using an adhesive material, such as frit glass, for example.

Further, the respective rod-like members 13X1 to 13Y2 include distal end portions 13X12, 13X22, 13Y12 and 13Y22 which constitute the above-mentioned projecting portions 132 which project at distal end sides of the respective joining portions.

Figure 2:
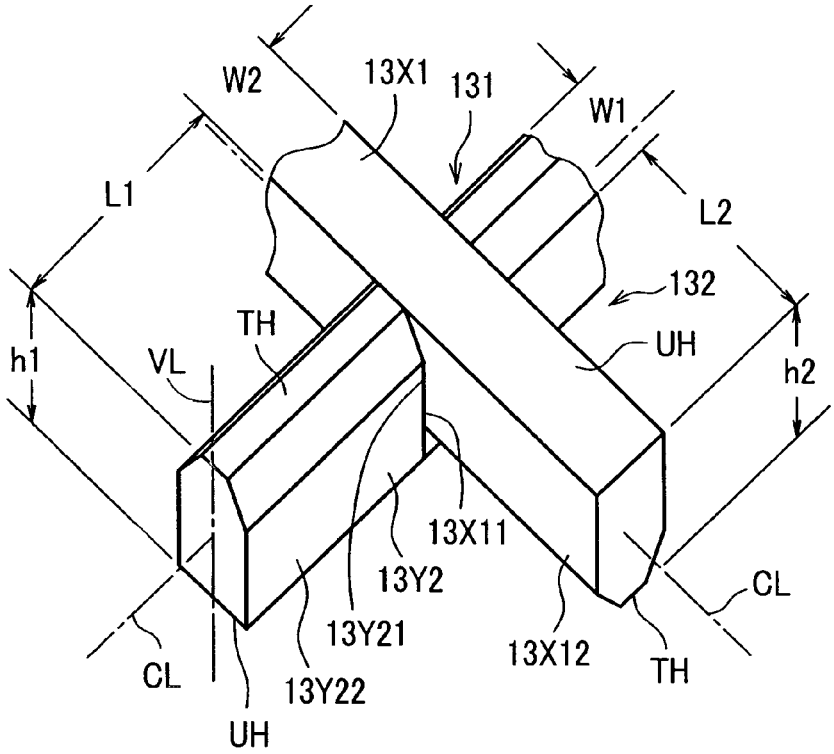
FIG. 2 is a perspective view showing a part of FIG. 1 in an enlarged manner.

FIG. 2 is a perspective view showing part of the support body 13 shown in FIG. 1 in an enlarged manner, wherein portions identical with the portions shown in FIG. 1 are given the same symbols.

In FIG. 2, the rod-like member 13Y2 is configured to have a width W1, a height h1 and an approximately hexagonal cross-sectional shape which orthogonally crosses a longitudinal axis CL, while the rod-like member 13X1, which is arranged orthogonal to the rod-like member 13Y2 and is adhered to and fixed to the rod-like member 13Y2, is configured to have a width W2, a height h2 and also an approximately hexagonal cross-sectional shape.

The rod-like member 13Y2 and the rod-like member 13X1 have lengths sufficient to provide the distal end portions 13Y22, 13X12, which extend outwardly by L1, L2 from the joining portions 13Y21, 13X11, which are positioned close to the respective end portions, thus forming the projecting portions 132.

The mutual sizes of widths W1, W2, the mutual sizes of heights h1, h2 and the mutual sizes of the distal end portion lengths L1, L2 may be set to be equal or to be different from each other. The same goes for the other rod-like members 13Y1, 13X2. Accordingly, the support body 13 may adopt a constitution which uses four rod-like members having one shape and size in combination.

Here, it is preferable for the height of the support body, which is constituted of the assembled body of these rod-like members, to be uniform over the whole surface thereof. This is because a constitution which includes large stepped portions may cause the leaking.

Figure 3:
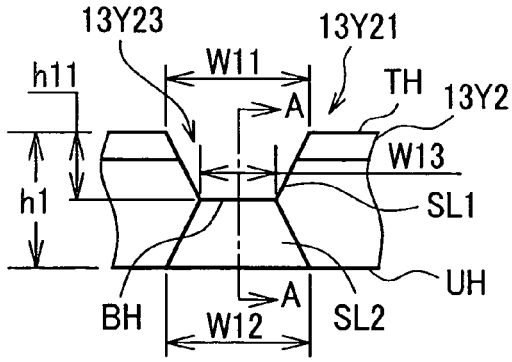
FIG. 3 is an enlarged side view showing a part of FIG. 2.
Figure 4:
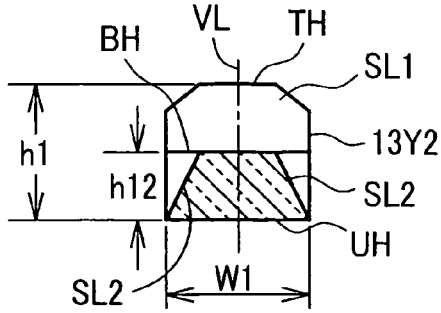
FIG. 4 is a cross-sectional view taken along a line A-A in FIG. 3.

FIG. 3 is a side view showing part of the joining portion 13Y21 shown in FIG. 1 and FIG. 2 in an enlarged manner, and FIG. 4 is a cross-sectional view taken along a line A-A in FIG. 3. In these drawings, portions identical with the portions shown in FIG. 1 and FIG. 2 are given the same symbols.

In FIG. 3 and FIG. 4, the joining portion 13Y21 of the rod-like member 13Y2 includes an approximately inverse-trapezoidal recessed portion 13Y23, which forms has an opening with a width of W11 on a top surface TH thereof extending in a direction parallel to the longitudinal axis CL, and which has a pair of inclined inner side surfaces SL1 extend in a direction toward a lower surface UH of the rod-like member from the opening to a depth of h11 and terminate on a bottom surface BH. In addition, a pair of inclined surfaces SL2 are provided which extend from the bottom surface BH of the recessed portion 13Y23 to the lower surface UH, intersect the above-mentioned inclined inner side surfaces SL1 at approximate right angle, and are arranged in an approximately symmetry with respect to a vertical center axis VL of the rod-like member.

The depth h11 of the recessed portion 13Y23 is set to be approximately one-half of the height h1 of the rod-like member and the remaining height is set as a height h12 in a direction parallel to the vertical center axis VL of the inclined surfaces SL2. Further, the opening width W11 is set to be approximately equal to the width W2 of the rod-like member 13X1, which is to be combined with the rod-like member 13Y2. Further, symbol W12 indicates the lower-surface-UH-side width of the inclined surface SL2, and the symbol W13 indicates the width of the bottom surface BH.

Figure 5:
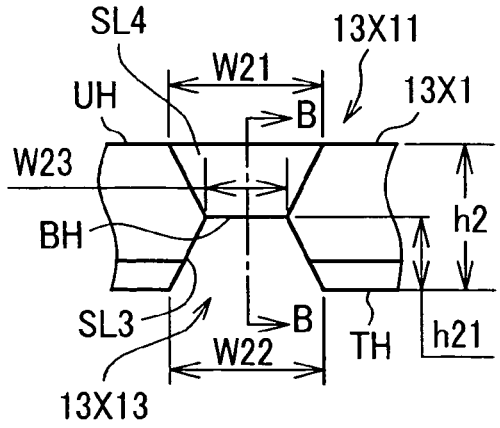
FIG. 5 is an enlarged side view showing another part of FIG. 2.
Figure 6:
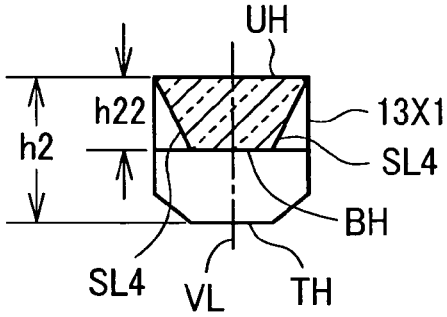
FIG. 6 is a cross-sectional view taken along a line B-B in FIG. 5.

FIG. 5 is a side view showing part of the joining portion 13X11 shown in FIG. 2 in an enlarged manner, and FIG. 6 is a cross-sectional view taken along a line B-B in FIG. 5. In these drawings, portions identical with the portions shown in FIG. 1 to FIG. 4 are given the same symbols.

In FIG. 5 and FIG. 6, the joining portion 13X11 of the rod-like member 13X1 has a shape such that the joining portion 13X11 and the joining portion 13Y21 can be approximately accurately fitted to engage each other when the joining portion 13X11 is arranged orthogonally with respect to the joining portion 13Y21 of the rod-like member 13Y2.

The joining portion 13X11 includes an approximately trapezoidal recessed portion 13X13, which forms an opening with a width of W22 on a top surface TH extending in a direction parallel to the longitudinal axis CL, and which has a pair of inclined inner side surfaces SL3 that extend in a direction toward a lower surface UH from the opening to a depth of h21 and terminate on a bottom surface BH. In addition, a pair of inclined surfaces SL4 are provided which continuously extend from the bottom surface BH of the recessed portion 13X13 to the lower surface UH, intersect the above-mentioned inclined inner side surfaces SL3 at approximate right angle, and are arranged in an approximately symmetry with respect to a vertical center axis VL of the rod-like member.

The recessed portion 13X13 has inclined inner side surfaces SL3 that correspond to the inclined surfaces SL2 shown in FIG. 3 and the inclined surfaces SL4 that correspond to the first inclined inner side surfaces SL1 of the recessed portion 13Y23, and these recessed portions and inner side surfaces are adhered and fixed to each other.

The depth h21 of the recessed portion 13X13 is set to be approximately one-half of the height h2 of the rod-like member and is set to a size approximately equal to the height h12 in the direction parallel to the vertical center axis VL of the inclined surfaces SL2 in FIG. 4, and the remaining height is set as a height h22 in a direction parallel to the vertical center axis VL of the inclined surfaces SL4. Further, the opening width W22 is set to be approximately equal to the width W1 of the rod-like member 13Y2, which is to be combined with the rod-like member 13X1. Further, symbol W21 indicates the lower-surface-UH-side width of the inclined surface SL4, and the symbol W23 indicates the width of the bottom surface BH.

Due to such a constitution, the joining portions can have a two-dimensional joining based on the combination of the recessed portions having an opening on the top surfaces and the inclined surfaces; and, hence, the mutual adhesion and fixing of the rod-like member can be ensured, and, at the same time, it is possible to increase the joining area, and, hence, the maintenance of the hermetic property can be enhanced.

Further, since the support body has projecting portions at the respective corner portions on a side opposite to the display region, it is is possible to prevent a warping of the substrate.

Further, since the rod-like members are mutually fixed to each other two-dimensionally on the joining surfaces, at the time of assembling the support body per se, at the time of sealing the support body and both substrates and, further, during a partial or whole evacuation step, it is possible to ensure the desired hermetic property maintaining function without using jigs for holding the support body.

Embodiment 2

Figure 7:
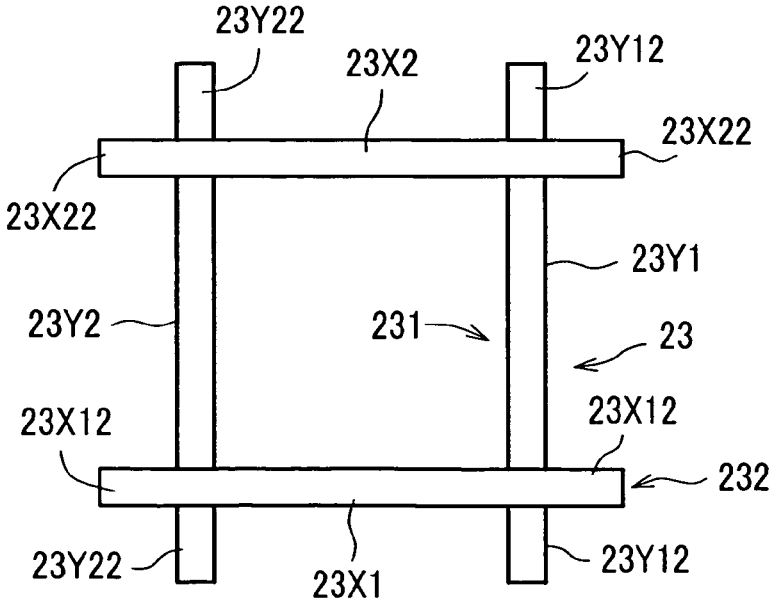
FIG. 7 is a plan view showing another embodiment of a support body of the image display device according to the present invention.
Figure 8:
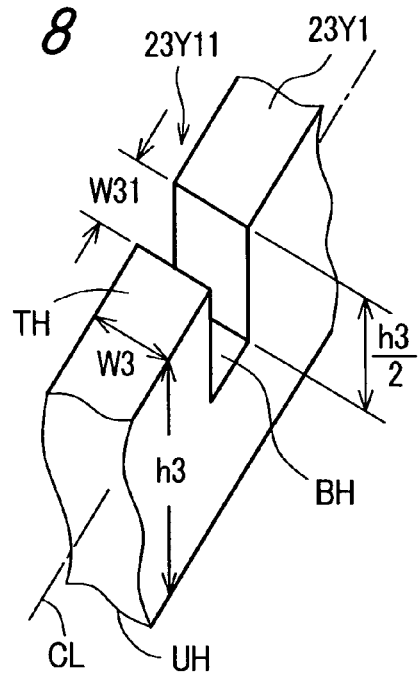
FIG. 8 is a perspective view showing another embodiment of a joining portion of the support body of the image display device according to the present invention.

FIG. 7 is a plan view of a support body representing a second embodiment of the present invention, and FIG. 8 is a perspective view of a joining portion shown in FIG. 7. In FIG. 7 and FIG. 8, portions identical with the above-mentioned portions in FIG. 1 to FIG. 6 are given the same symbols.

In FIG. 7 and FIG. 8, a support body 23 is configured such that a plurality of rod-like members 23X1, 23X2, 23Y1, 23Y2 are combined in a projected-parallel shape to form an approximately rectangular frame body 231 having a size sufficient to surround the display region and projecting portions 232, which are arranged outside the frame body 231. The height of the support body 23 is set to be uniform over the whole surface.

The respective rod-like members 23X1 to 23Y2 include joining portions 23Y11 having the same shape, which are formed of the constitution shown in FIG. 8 at respective engaging portions thereof with the rod-like members to be combined, wherein the respective rod-like members 23X1 to 23Y2 are adhered and fixed to each other at these joining portions 23Y11 using an adhesive material, such as frit glass, for example.

Further, the respective rod-like members 23X1 to 23Y2 include distal end portions 23X12, 23X22, 23Y12 and 23Y22 which constitute the above-mentioned projecting portions 232 at distal end sides of the respective joining portions.

FIG. 8 is a perspective view showing part of the joining portion 23Y11 in an enlarged manner.

In FIG. 8, the rod-like member 23Y1 has a width W3 and a height h3. The joining portion 23Y11 of the rod-like member 23Y1 has an opening with a width of W31 extending in a direction parallel to a longitudinal axis CL on a top surface TH of the rod-like member 23Y1. Further, an approximately square or polygonal recessed portion, which extends in the direction toward a lower surface UH to a depth of h3/2 from the opening with a width equal to the width W31 and which terminates at a bottom surface BH, is formed in the joining portion 23Y11.

Here, the rod-like member 23Y2 may be configured such that the width W3 and the height h3 have the same size.

According to the constitution of this second embodiment, the shape of the joining portion is simple, and, at the same time, the joining portion provides a two-dimensional joining, and, hence, a mutual adhesion and fixing of the rod-like members is ensured.

Further, since the support body has projecting portions at the respective corner portions on a side opposite to the display region, it is possible to prevent warping of the substrate.

Embodiment 3

Figure 9:
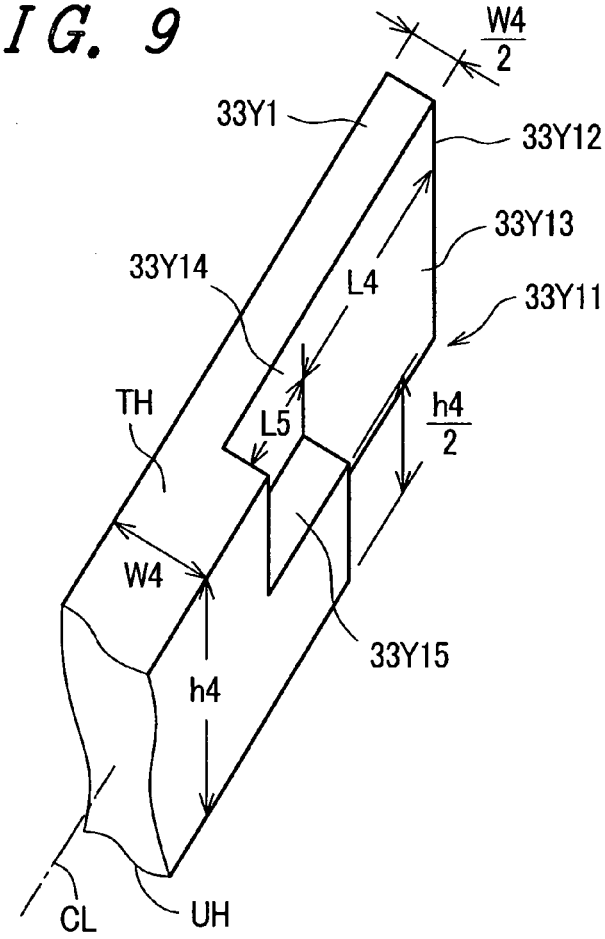
FIG. 9 is a perspective view showing still another embodiment of a joining portion of the support body of the image display device according to the present invention.

FIG. 9 is a perspective view illustrating the shape of a joining portion of a rod-like member representing a third embodiment of the present invention, wherein portions identical with the above-mentioned portions in FIG. 1 to FIG. 8 are given the same symbols.

In FIG. 9, a rod-like member 33Y1 has a width W4 and a height h4, and a joining portion 33Y11 is formed on an end portion of the rod-like member 33Y1.

The joining portion 33Y11 has a first thin-wall portion 33Y13 in which the thickness thereof over a length L4 extending toward the longitudinal center from a longitudinal end surface 33Y12 of the rod-like member 33Y1 is set to one-half of the width W4. The joining position 33Y11 also has a second thin wall portion 33Y14 in which thickness of a portion thereof over a length L5 extending further inwardly and extending downwardly to one-half of the height h4 is set to the same thickness as the first thin wall portion 33Y13, thus forming a stepped portion 33Y15.

Here, it is possible to set the longitudinal length L4 of the first thin wall portion 33Y13 to be larger than the height h4, thus forming a portion of the first thin wall portion 33Y13 into a projecting portion of the support member. Further, the length L5 may be set by taking the maintenance of the hermetic property into consideration.

Further, the rod-like member 33Y1 may be configured such that the width W4 and the height h4 have the same size.

According to the constitution of this third embodiment, the shape of the joining portion is simple, and, at the same time, due to the provision of the stepped portion, large bonding area can be ensured, and, hence, the maintenance of the hermetic property is enhanced.

Embodiment 4

Figure 10:
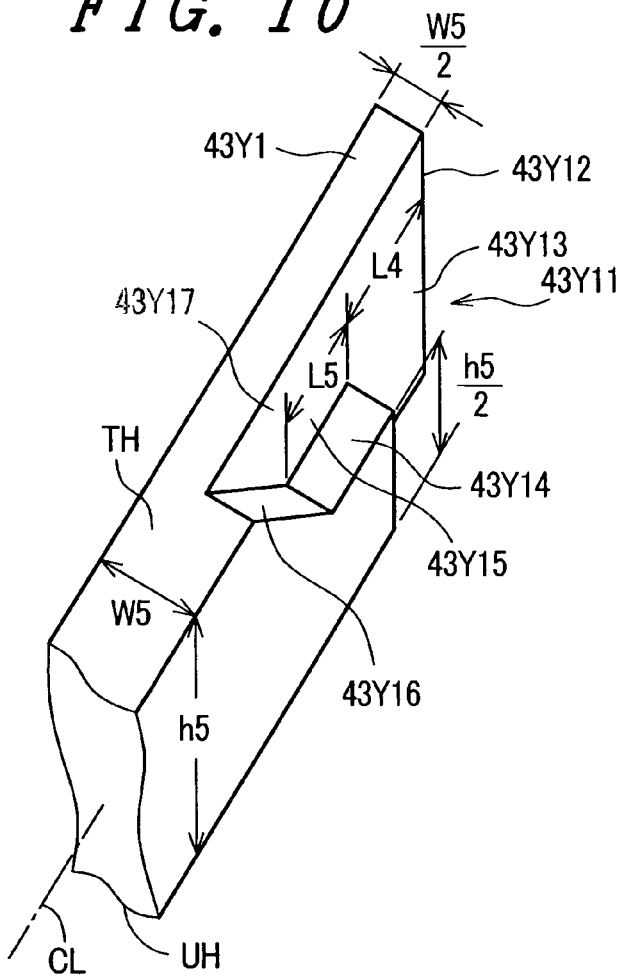
FIG. 10 is a perspective view showing still another embodiment of a joining portion of the support body of the image display device according to the present invention.

FIG. 10 is a perspective view illustrating shape of a joining portion of a rod-like member representing a fourth embodiment of the present invention, wherein portions identical with the above-mentioned portions in FIG. 1 to FIG. 9 are given the same symbols.

In FIG. 10, the rod-like member 43Y1 has a width W5 and a height h5, and a joining portion 43Y11 is formed on an end portion of the rod-like member 43Y1.

The joining portion 43Y11 has a first thin-wall portion 43Y13 in which the thickness thereof over a length L4 extending toward the longitudinal center from a longitudinal end surface 43Y12 of the rod-like member 43Y1 is set to one-half of the width W5 in the same manner as the first thin wall portion 33Y13 shown in FIG. 9. The joining portion 43Y11 also has a second thin wall portion 43Y15 which has a stepped portion 43Y14 similar to the stepped portion 33Y15 shown in FIG. 9, further extending inwardly by a length L5. Further, the joining portion 43Y11 includes a third thin wall portion 43Y17 which has an inclined stepped portion 43Y16 which is contiguously formed with the stepped portion 43Y14 and has an inclined surface inside the stepped portion 43Y14.

The third thin wall portion 43Y17 has the same plate thickness as the first thin wall portion 43Y13 on the top surface TH side of the inclined stepped portion 43Y16.

Further, although the lower surface UH side of the stepped portion 43Y14 has a thickness equal to the width W5 at a portion up to one-half of the height h5, this configuration is equal to the configuration shown in FIG. 9.

Further, the rod-like member 43Y1 may be configured such that the width W5 and the height h5 are the same.

According to the constitution of this fourth embodiment, due to the presence of the inclined surface in addition to the stepped portion, a large bonding area can be ensured, and, hence, the maintenance of the hermetic property is enhanced.

Embodiment 5

Figure 11:
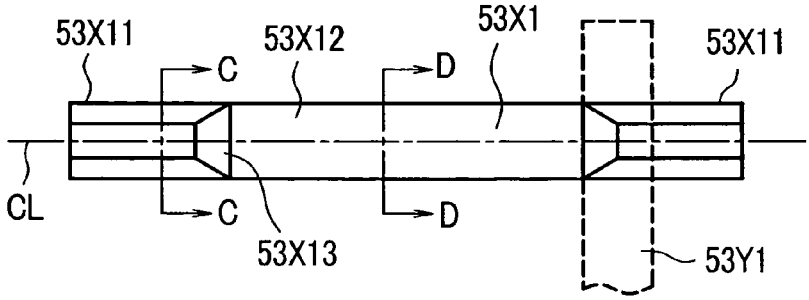
FIG. 11 is a plan view showing still another embodiment of a rod-like member of the support body of the image display device according to the present invention.
Figure 12:
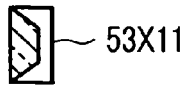
FIG. 12 is a cross-sectional view taken along a line C-C in FIG. 11.
Figure 13:
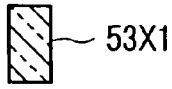
FIG. 13 is a cross-sectional view taken along a line D-D in FIG. 11.

FIG. 11 is a plan view showing the a shape of a rod-like member representing a fifth embodiment, FIG. 12 is a cross-sectional view taken along a line C-C in FIG. 11, and FIG. 13 is a cross-sectional view taken along a line D-D in FIG. 11. In these drawings, portions identical with the above-mentioned portions in FIG. 1 to FIG. 10 are given the same symbols.

In FIG. 11 to FIG. 13, a longitudinal end portion 53X11 of a rod-like member 53X1 has a trapezoidal cross-sectional shape orthogonal to a longitudinal axis, as shown in FIG. 12, while a center portion 53X12 has a rectangular cross-sectional shape, as shown in FIG. 13. Symbol 53X13 indicates boundary portions.

With respect to this rod-like member 53X1, in combining the rod-like member 53X1 with the other rod-like member 53Y1, for example, joining portions may fall in ranges from the boundary portions 53X13 to the both end portions 53X11.

Due to such a constitution, both end portions which constitute the joining portions form a trapezoidal shape, and, hence, it is possible to ensure the long bonding areas, thus enhancing the reliability of the bonding.

Embodiment 6

Figure 14:
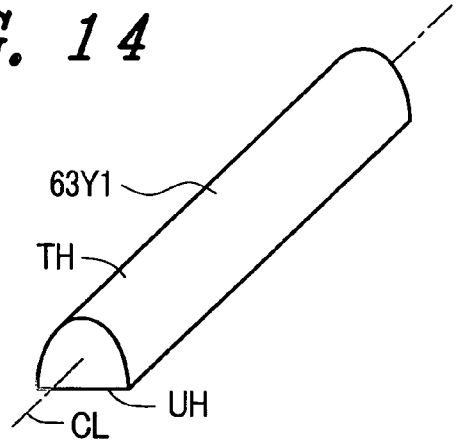
FIG. 14 is a perspective view showing still another embodiment of the rod-like member of the support body of the image display device according to the present invention.

FIG. 14 is a perspective view showing the a shape of a rod-like member representing a sixth embodiment, in which and portions identical with the above-mentioned portions in FIG. 1 to FIG. 13 are given the same symbols.

In FIG. 14, a rod-like member 63Y1 is characterized by having an approximately semicircular cross-sectional shape orthogonal to a longitudinal axis CL. According to this constitution, by arranging a lower surface UH to face a substrate in an opposed manner, and by arranging a joining portion on a top surface TH side, it is possible to ensure a wide bonding area with the substrate.

Embodiment 7

Figure 15:
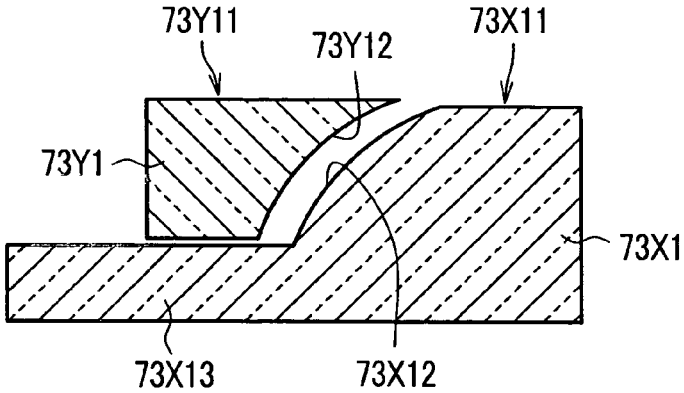
FIG. 15 is a perspective view showing still another embodiment of the joining portion of the support body of the image display device according to the present invention.

FIG. 15 is a cross-sectional view showing the shape of a bonding portion of a rod-like member representing a seventh embodiment, in which and portions identical with the above-mentioned portions in FIG. 1 to FIG. 14 are given the same symbols.

In FIG. 15, a bonding portion 73X11 of a rod-like member 73X1 and a bonding portion 73Y11 of a rod-like member 73Y1, which crosses the bonding portion 73X11 at a right angle both have gentle curved bonding surfaces. That is, the bonding portion 73X11 of the rod-like member 73X1 has a gentle convex curved surface 73X12 and a thin wall portion 73X13, and a projecting portion is formed using a portion of the thin wall portion 73X13.

On the other hand, the bonding portion 73Y11 of the rod-like member 73Y1 has a gentle concave curved surface 73Y12, which substantially corresponding in shape to the convex curved surface 73X12, and this concave curved surface 73Y12 and the convex curved surface 73X12 are arranged to face each other and are adhered and fixed to each other using an adhesive material. In this constitution, the curved surfaces are set to such an extent that flowing out of the adhesive material which is interposed between both curved surfaces can be prevented.

According to this constitution, since the bonding portions have the gentle curved surface portions, the flow of the adhesive material interposed between the bonding portions can be suppressed, whereby a long bonding distance of the bonding surfaces, including the gentle curved portions, can be uniformly maintained, thus enhancing the hermetic property maintaining function.

Embodiment 8

Figure 16:
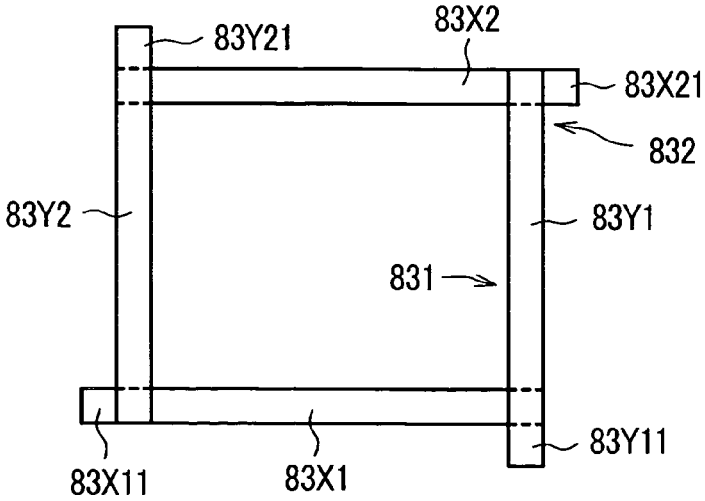
FIG. 16 is a plan view showing still another embodiment of the support body of the image display device according to the present invention.

FIG. 16 is a plan view showing a support body eighth embodiment, in which portions identical with the above-mentioned portions in FIG. 1 to FIG. 15 are given the same symbols.

In FIG. 16, the support body 83 is configured such that a plurality of rod-like members 83X1, 83X2, 83Y1, 83Y2 are combined in a projected-parallel shape to form an approximately rectangular frame body 831 having a size sufficient to surround the display region, and the frame body 831 has projecting portions 832, which are arranged outside the frame body 831. The height of the support body 831 is uniform over the whole surface.

Each one of the respective rod-like members 83X1 to 83Y2 has bonding portions at two portions consisting of a longitudinal end portion and a portion which is spaced toward the center from the longitudinal end portion. The bonding portions have, for example, the constitution shown in FIG. 9 or FIG. 10, or a constitution which conforms to such a constitution. Accordingly, when the rod-like members 83X1 to 83Y2 are assembled to form the support body, the joining portion at the end portion of each rod-like member is adhered and fixed to the bonding portion at the portion spaced toward the center portion from the end portion of another rod-like member with which it is to be combined.

In such a support body 831, the number of the distal end portions 83X11, 83X21, 83Y11 and 83Y21 which constitute the projecting portions 832 is set to be one-half of the distal end portions of the above-mentioned embodiments. According to this embodiment, since the projecting portions are formed on respective corner portions, it is possible to prevent a warping of the substrate.

Embodiment 9

Figure 17:
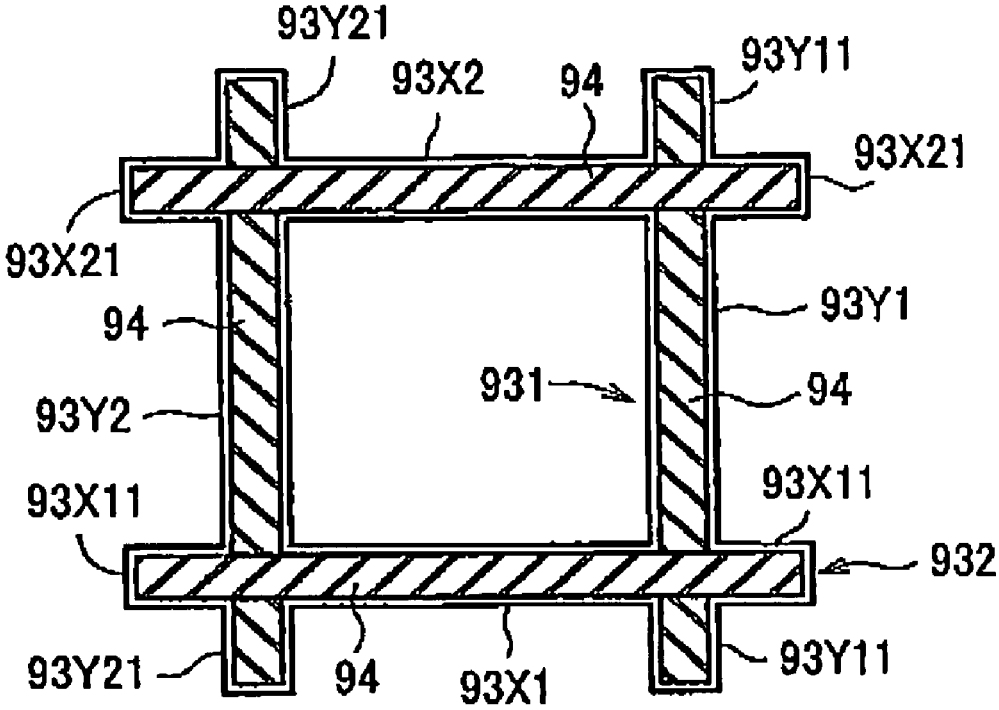
FIG. 17 is a plan view of part of another embodiment of the image display device according to the present invention.
Figure 18:
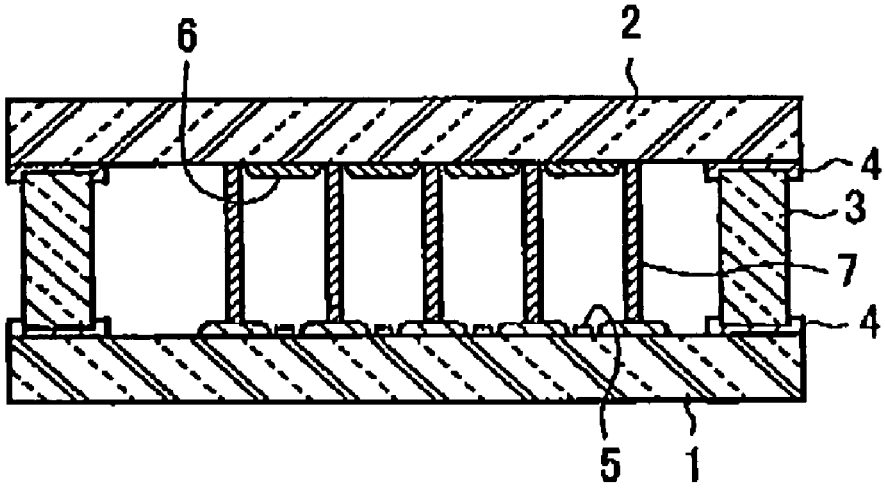
FIG. 18 PRIOR ART
FIG. 18 is a cross-sectional view showing the constitution of a conventional image display device.

FIG. 17 is a plan view showing part of a support body portion representing a ninth embodiment, in which portions identical with the above-mentioned portions in FIG. 1 to FIG. 16 are given the same symbols.

In FIG. 17, a support body 93 is configured such that a plurality of rod-like members 93X1, 93X2, 93Y1, 93Y2 are combined in a projected-parallel shape to form an approximately rectangular frame body 931 having a size sufficient to surround the display region, and the frame body 931 has projecting portions 932 which are arranged outside the frame body 931. The height of the support body 93 is uniform over the whole surface.

Further, the respective rod-like members 93X1 to 93Y2 include joining portions at respective crossing portions. The respective rod-like members 93X1 to 93Y2 further include distal end portions 93X11, 93X21, 93Y11 and 93Y21 which constitute the above-mentioned projecting portions 932 at distal end sides outside the respective joining portions. Further, an adhesive material 94 is applied to approximately the whole front and back surfaces of the support body 93, including the distal end portions.

According to such a constitution, it is possible to adhere and fix both substrates to each other with the projection portions disposed therebetween, and, hence, warping of the substrate can be prevented.

What is claimed is:

1. An image display device comprising:

a face substrate which forms anodes and phosphors on an inner surface thereof;

a back substrate which forms a plurality of electron sources on an inner surface thereof and faces the face substrate in an opposed manner with a given distance therebetween;

a support body which is interposed between the face substrate and the back substrate and surrounds a display region and holds the given distance; and a sealing material which hermetically seals end surfaces of the support body and the face substrate and the back substrate, wherein the support body is constituted of a plurality of rod-like members, the plurality of rod-like members are combined and bonded, the plurality of rod-like members are adhered and fixed to each other at the bonding portions using an adhesive material, and the support body includes projecting portions which project in the direction opposite to the display region, and the projecting portions are provided outside the bonding portions.

2. An image display device according to claim 1, wherein the projecting portions are provided to corner portions of the support body.

3. An image display device according to claim 1, wherein the projecting portions are provided to the respective corner portions.

4. An image display device according to claim 1, wherein the rod-like members include the joining portions at positions moved in the center direction from longitudinal end portions thereof.

5. An image display device according to claim 1, wherein the rod-like members includes the joining portions on the longitudinal end portions.

6. An image display device according to claim 4, wherein the joining portion includes a recessed portion.

7. An image display device according to claim 6, wherein the joining portion is formed of a square-hole-shaped recessed portion.

8. An image display device according to claim 1, wherein the projecting portions include a sealing material.

* * * * *